US005788071A

United States Patent [19]

Shiao

[11] Patent Number: 5,788,071

[45] Date of Patent: Aug. 4, 1998

[54] INTERNAL BRACING DEVICE FOR A GOLF BAG

[76] Inventor: Kun-lin Shiao, No. 14, Shih 1st Rd., Youth Ind. Park, Yangmei Chen, Taoyuan Hsien, Taiwan

[21] Appl. No.: 786,440

[22] Filed: Jan. 21, 1997

[51] Int. Cl.[6] ..... A63B 55/00

[52] U.S. Cl. ..... 206/315.8; 206/315.3

[58] Field of Search ..... 206/315.3, 315.7, 206/315.8

[56] References Cited

U.S. PATENT DOCUMENTS

| | | | |
|---|---|---|---|
| 4,378,039 | 3/1983 | Suk | 206/315.8 |
| 4,865,192 | 9/1989 | Williams | 206/315.7 |
| 5,445,267 | 8/1995 | Biafore, Jr. | 206/315.8 |
| 5,638,954 | 6/1997 | Hsien | 206/315.8 |
| 5,725,095 | 3/1998 | Beck et al. | 206/315.8 |

*Primary Examiner*—Stephen Cronin
*Attorney, Agent, or Firm*—William E. Pelton

[57] ABSTRACT

An internal racing device for a golf bag includes a socket integrally formed within the golf bag and constructed to have a centrally defined hole, a pair of stops each opposingly formed on an upper periphery thereof, and a pair of recesses each defined adjacent to a respective stop and a tubular seat constructed to have a pair of wings each opposingly formed on an upper periphery thereof and a flange integrally formed with a base thereof, so that after a distal tip of one of a plurality of struts is inserted into a first hole defined within an upper frame of the bag, the other distal tip of the strut is able to be retained within the tubular seat when the wings of the tubular seat is securely rested within the recesses and stopped by the stops of the socket.

4 Claims, 4 Drawing Sheets

INTERNAL BRACING DEVICE FOR A GOLF BAG

FIELD OF THE INVENTION

The present invention generally relates to an internal bracing device, and more particularly to an internal bracing device for a golf bag, which provides easy installation and replacement to a user.

BACKGROUND OF THE INVENTION

As golf becomes more and more popular around the world, people start to notice the existence and importance of a golf bag which originally was only a bag made of cloth or some soft material and having an upper frame having a plurality of first sockets defined therein, a lower frame and a plurality of struts connected therebetween, so that the bag will be rigid and not callapse between the upper frame and the lower frame. The bag is constructed to have a plurality of sockets integrally formed with the lower frame and within the bag, therefore, after a first distal tip of one strut is firstly inserted into one of the first holes of the upper frame, a second distal tip of the strut will be securely received within one of the sockets by fixing the strut to the socket with a fastener such as a rivet from an out side of the bag. A golf bag having a construction as previously described will be rigid when in practical use, nevertheless, many facts show that the struts securely received between the upper frame and the lower frame are practically mounted therebetween, which increases the difficulty in repairing the golf bag if some of the struts are broken and need to be fixed. On some occasions, the struts even fall out from the lower frame. Some golfers might be affected by the embarrassing situations and will not be able to have good score; some golfers may even drop out a game. Furthermore, a lot of users will only polish the clubs and not the bag, which is also a main reason to cause deterioration of the bag.

From the previous description, it is noted that many golf bags sold in the market can not fulfill the requirements of most golfers. Thus, a golf bag having a an internal bracing device mounted therein and constructed in accordance with the present invention tends to mitigate and/or obviate the aforementioned problems.

SUMMARY OF THE INVENTION

The main objective of the invention is to provide a an internal bracing device for a golf bag. According to one aspect of the invention, the an internal bracing device includes a socket and a tubular seat which is rotatably received within the socket. The socket is integrally formed within the golf bag and constructed to have a first hole centrally defined therein, two passages each opposingly defined to the other and communicating with the first hole, two stops each formed opposingly with each other and on an upper periphery of the socket and two recesses each integrally defined adjacent to one of the stops. The tubular seat is constructed to have a centrally defined channel, two opposed wings each integrally formed on an upper periphery thereof and a base having a flange formed therewith. Therefore, a first distal tip of one of plurality of struts will be able to be fixedly received within the channel of the tubular seat after a second distal tip of the strut is securely inserted into a second hole defined in a top frame of the bag and the tubular seat is inserted into the first hole of the socket via the wings of the tubular seat sliding along the passage of the socket and then turned to an angle.

It is another object of the invention to provide a golf bag which does not use screws, nails or rivets to fasten the struts, and still provides an easy installation and/or replacement to a golfer.

Other objects, advantages and novel features of the invention will become more apparent from the following detailed description when taken in conjunction with the accompanying drawings.

BRIEF DESCRIPTION OF THE DRAWINGS

The present invention will now be better understood with reference of the accompanying drawings wherein.

DETAILED DESCRIPTION OF THE PREFERRED EMBODIMENT

Figure 1:
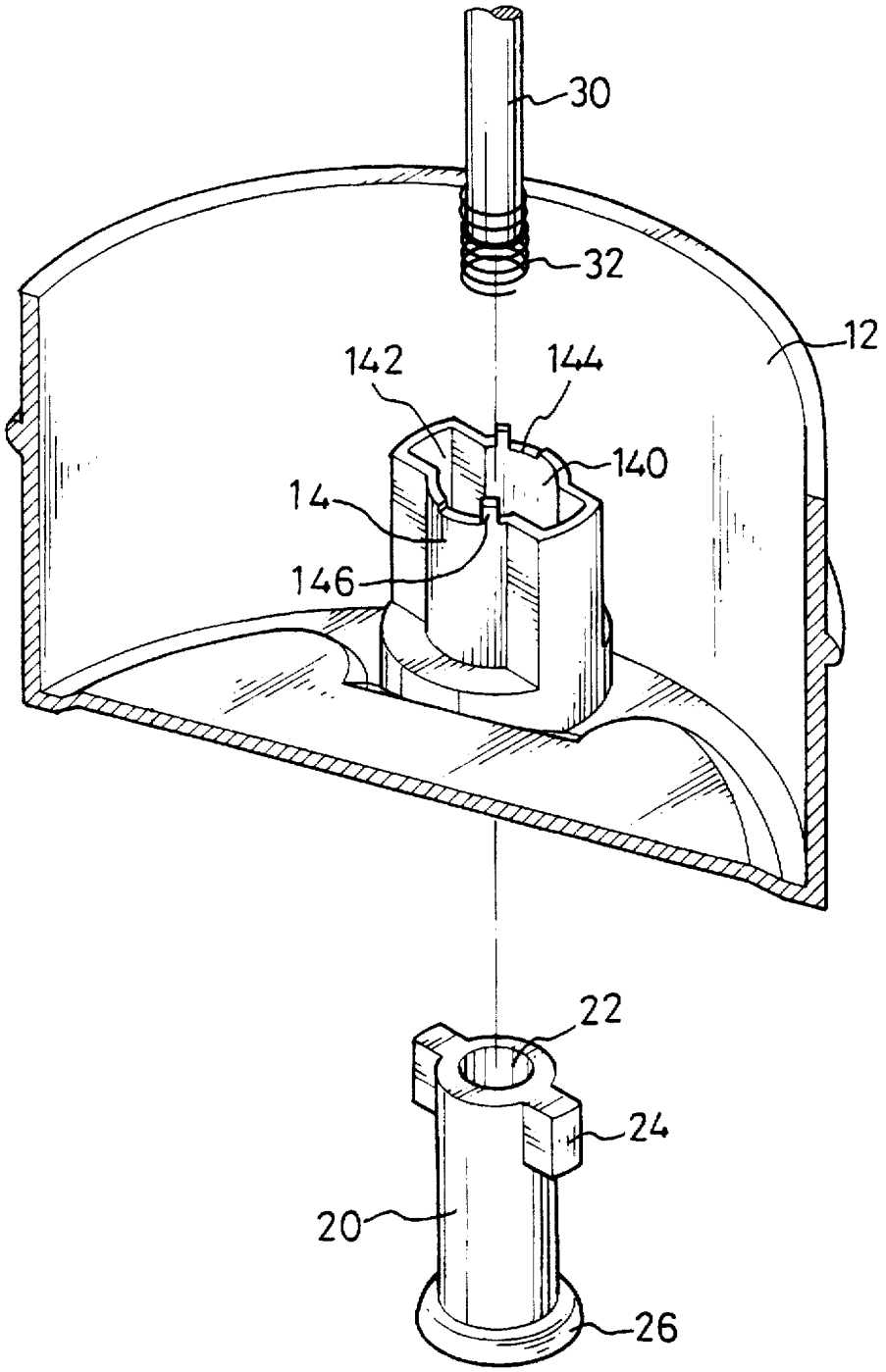
FIG. 1 is a perspective view of a an internal bracing device constructed in accordance with the present invention.

Referring to FIG. 1, an internal bracing device constructed in accordance with the present invention is shown. The internal bracing device Includes a socket 14 and a tubular seat 20 which is rotatably received within the socket 14. The socket 14 is integrally formed within a golf bag 12 and constructed to have a first hole 140 centrally defined therein, two passages 142 each opposingly defined to the other and communicating with the first hole 140, two stops 146 each formed opposingly with each other and on an upper periphery of the socket 14 and two recesses 144 each defined adjacent to a respective one of the stops 146. The tubular seat 20 is constructed to have a centrally defined channel 22, two opposed wings 24 each integrally formed on an upper periphery thereof and a base (not numbered) having a flange formed therewith Furthermore, a strut 30 having a spring 32 securely attached to a first distal tip thereof is also shown in the figure.

Figure 2:
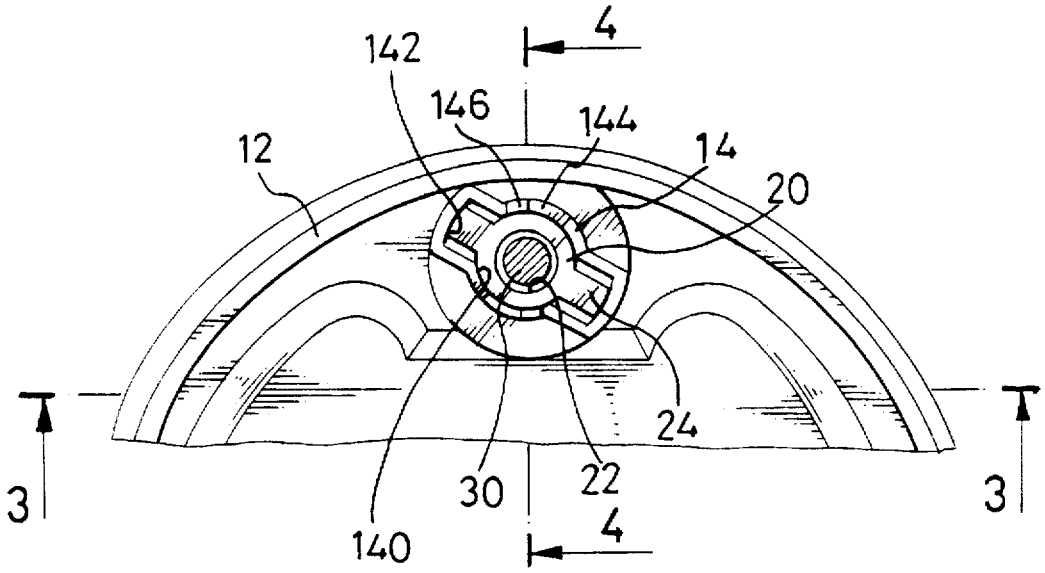
FIG. 2 is a schematic top plan view of the an internal bracing device assembled within a golf bag.

Referring to FIGS. 1 and 2, when the an internal bracing device of the invention is in use, the first distal tip of the strut 30 is firstly inserted into the channel 22 of the tubular seat 20, and then the Tubular seat 20 together with the strut 30 is inserted into the first hole 140 of the socket 14 via the wings 24 of the tubular seat 20 sliding along the passages 142 of the socket 14 until the flange 26 of the tubular seat 20 engages with a bottom face (not numbered) of the bag 12.

Figure 3:
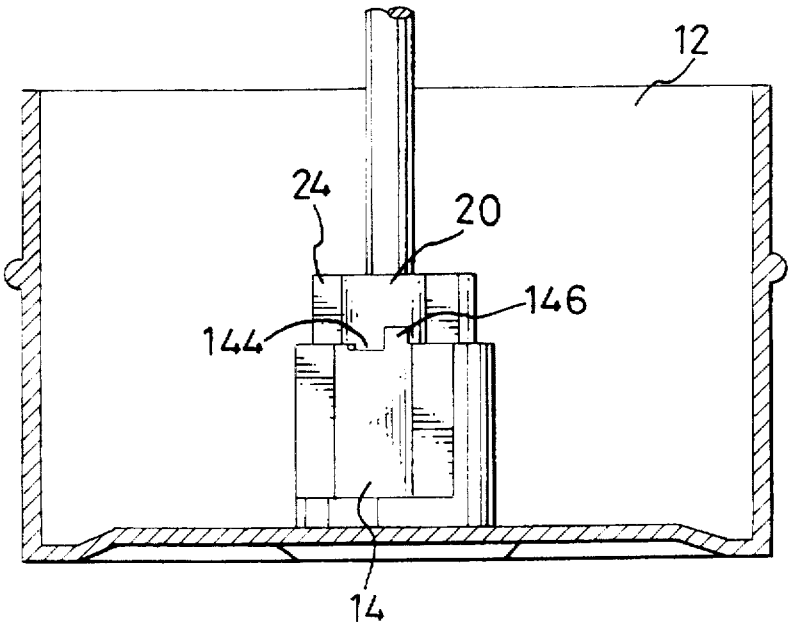
FIG. 3 is a partial cross sectional view of the an internal bracing device according to line 3—3 of FIG. 2.

FIG. 3 shows that when the tubular seat 20 together with the strut 30 is inserted into the socket 14 and the flange 26 is stopped by the bottom face of bag 12, the wings 24 of the tubular seat 20 are still distant from the stops 146 of the socket 14. Additionally, FIG. 4 also shows that when a second distal tip of the strut 30 is finally inserted into a second hole 42 defined in a top frame 40 of the bag 12, the spring 32 securely attached to a first distal tip of the strut 30 will be compressed. It is noted that a concavity 16 having a diameter slightly bigger than a diameter of the flange 26 of the tubular seat 20 is defined in the bottom face of the bag 12 and communicates with the first hole 140 of the socket 14, so that when the tubular seat 20 is inserted into the first: hole 140 of the socket 14, the flange 26 will be received within the concavity 16 of the bottom face of the bag 12.

Figure 4:
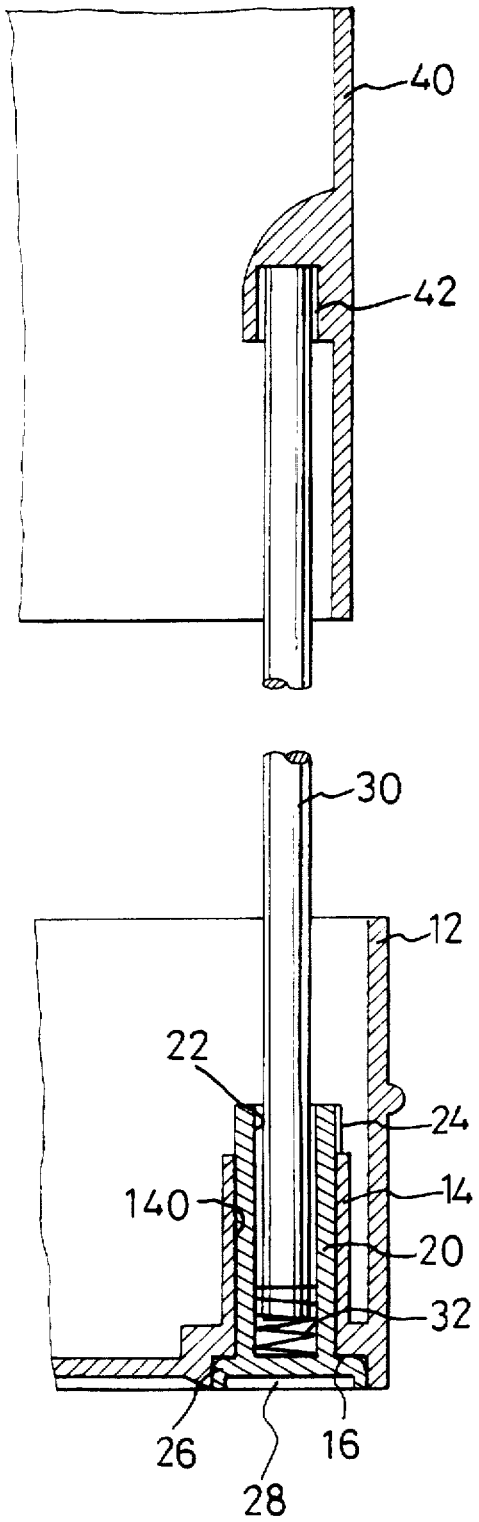
FIG. 4 is another partial cross sectional view of the an internal bracing device according to line 4—4 of FIG. 2.

Still referring to FIG. 4, a slot 28 is defined in the base of the tubular seat 20, therefore, a user is able to turn the tubular seat 20 with tools, such as screw driver, etc., to an angle after the tubular seat 20 is snugly received within the concavity 16.

Figure 5:
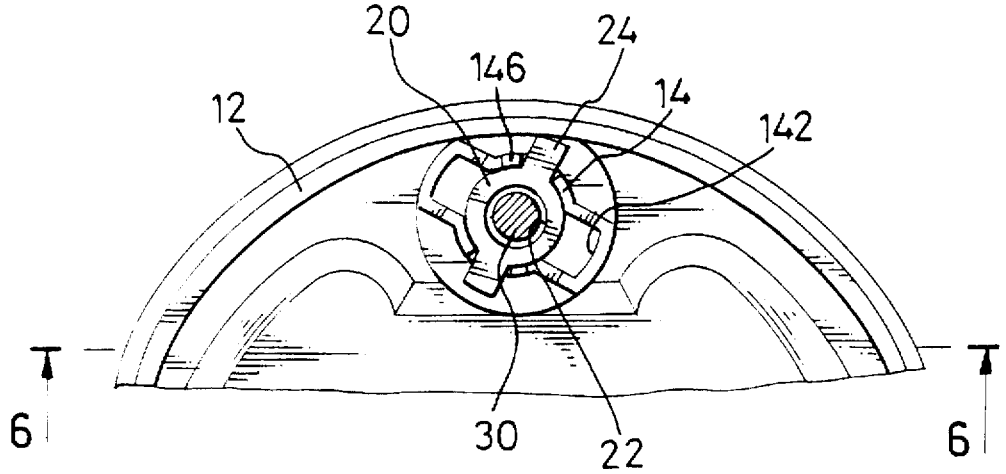
FIG. 5 is a schematic top plan view showing that the an internal bracing device is assembled within the golf bag and a tubular seat is turned to an angle.
Figure 6:
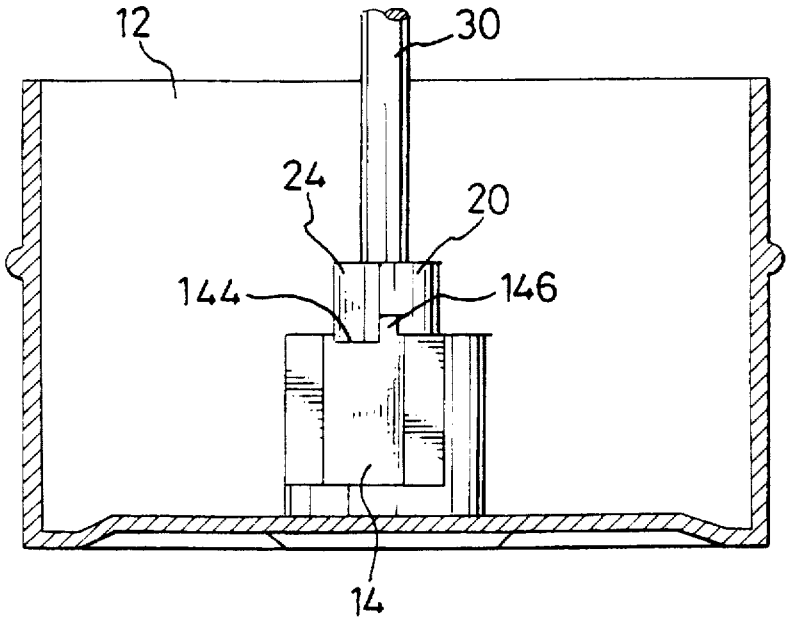
FIG. 6 is a partial cross sectional view of the an internal bracing device according to line 6—6 of FIG. 5.

As shown in FIGS. 5 and 6, after the tubular seat 20 is turned to an angle within the socket 14, the wings 24 of the tubular seat 20 will be stopped by the stops 146 of the socket 14, whereby the wings 24 will naturally and respectively be rested within the recesses 144 near the stops 146 and thus the tubular sear 20 will be securely maintained on an upper periphery of the socket 14. As previously mentioned, after the second distal tip of the strut 30 is inserted into the second hole 42 of the top frame 40, the first distal tip of the strut 30 is received within the channel 22 of the tubular seat 20 and the tubular seat 20 is securely maintained on the upper periphery of the socket 14, the golf bag 12 is able to stand upright.

Therefore, the description above shows that the golf bag 12 having an internal bracing device installed therein uses molded injection socket 14 and tubular seat 20 to receive a plurality of struts therein. The injection molding provides inexpensive mass production.

From the foregoing, it is seen that the objects hereinbefore set forth may readily and efficiently be attained, and since certain changes may be made in the above construction and different embodiments of the invention without departing from the scope thereof, it is Intended that all matter contained in the above description or shown in the accompanying drawings shall be interpreted as illustrative and not in a limiting sense.

What is claimed is:

1. An internal bracing device for a golf bag comprising a socket integrally formed within said bag and a tubular seat rotatably received within said socket, wherein the improvement is:

said socket is constructed to have a centrally defined hole, a pair of stops each opposingly formed on an upper periphery thereof;

said tubular seat is constructed to have a pair of wings each opposingly and integrally formed on an upper periphery thereof and a flange integrally formed with a base thereof.

2. The internal bracing device for a golf bag as claimed in claim 1, wherein said socket further has a pair of recesses defined adjacent to each of said stops for respectively resting each of said wings therein.

3. The internal bracing device for a golf bag as claimed in claim 1, wherein a concavity having a diameter bigger than a diameter of sa d flange of said tubular seat such that said flange is able to be received within said concavity of said bag.

4. The internal bracing device for a golf bag as claimed in claim 1, wherein a slot is further defined in said base of said tubular seat.

* * * * *